US005926195A

United States Patent [19]

Domhoff et al.

[11] Patent Number: 5,926,195

[45] Date of Patent: Jul. 20, 1999

[54] INK JET PRINTHEAD CARTRIDGE

[75] Inventors: Joseph Edwin Domhoff, Shelbyville; Ganesh Vinayak Phatak, Lexington, both of Ky.

[73] Assignee: Lexmark International Inc., Lexington, Ky.

[21] Appl. No.: 08/755,520

[22] Filed: Nov. 22, 1996

[51] Int. Cl.[6] ..... B41J 2/175

[52] U.S. Cl. ..... 347/87

[58] Field of Search ..... 347/49, 84, 85, 347/86, 87

[56] References Cited

U.S. PATENT DOCUMENTS

| | | | |
|---|---|---|---|
| 4,513,297 | 4/1985 | Okamura | 347/85 |
| 4,812,859 | 3/1989 | Chan et al. | 347/63 |
| 5,025,271 | 6/1991 | Baker et al. | 347/87 |
| 5,497,178 | 3/1996 | DeFosse et al. | 347/87 |
| 5,619,239 | 4/1997 | Kotaki et al. | 347/86 |
| 5,661,510 | 8/1997 | Brandon et al. | 347/87 |

FOREIGN PATENT DOCUMENTS

| | | | |
|---|---|---|---|
| 2-188249 | 7/1990 | Japan | B41J 2/01 |

*Primary Examiner*—N. Le
*Assistant Examiner*—Ahn T. N. Vo
*Attorney, Agent, or Firm*—Ronald K. Aust

[57] ABSTRACT

A multi-chamber liquid ink jet printhead cartridge is provided that includes two or more adjacently disposed and parallel rectangular ink storage chambers with at least one additional rectangular ink storage chamber disposed in front of and perpendicularly with the parallel chambers, Enclosed channels connect the chambers to corresponding orifices which are located under the front chamber.

5 Claims, 3 Drawing Sheets

INK JET PRINTHEAD CARTRIDGE

TECHNICAL FIELD

This invention pertains to a novel ink jet printhead configuration. Particularly it relates to an ink jet printhead configuration which maximizes the overall volume of the ink chambers while minimizing the overall size of the print cartridge.

BACKGROUND OF THE INVENTION

Ink jet printing is accomplished by ejecting ink from a nozzle toward paper or another print medium. The ink is driven from the nozzle toward the medium in a variety of ways. For example, in electrostatic printing the ink is driven by an electrostatic field. Another ink jet printing procedure, known as squeeze tube, employs a piezo-electric element in the ink nozzle. Electrically caused distortions of the piezo-electric element pump the ink through the nozzle and toward the print medium. In still another ink jet printing procedure known as thermo or bubble ink jet printing, the ink is driven from the nozzle toward the print medium by the formation of an expanding vapor phase bubble in the nozzle. These various printing methods are described in "Output Hard Copy Devices," edited by Durbeck and Sherr, Academic Press, 1988 (see particularly chapter 13, entitled "Ink Jet Printing").

The ink to be printed by any of the ink jet printing methods is typically stored in an ink chamber. The ink then flows from the chamber to the nozzle where it is ejected toward the print medium. An ink jet printhead can have more than one chamber. For a colored printhead it is preferable that the ink jet printhead have at least two ink chambers. As the number of chambers increases, the overall size of the printhead cartridge must increase or else the volume of each individual chamber must be decreased. Typically, overall printhead size is limited by space constraints in the printer. In addition, it is not desirable to reduce ink volume because this requires replacement of the printhead cartridge more frequently.

The prior art, such as U.S. Pat. No. 4,812,859, Chan, et al., issued Mar. 14, 1989, teaches the use of multi-chamber ink jet printheads wherein the individual ink chambers are aligned side-by-side. When the printhead contains three or more ink chambers and the chambers are aligned linearly, the ink from the chamber farthest from the nozzle must flow across at least one chamber width before arriving at the nozzle. This wastes ink as the entire length of the flow channel must be filled with ink. In addition, the side-by-side arrangement of all of the chambers provides a very wide and cumbersome printhead.

U.S. Pat. No. 4,513,296, Okamura, issued Apr. 23, 1985, teaches the use of L-shaped chambers stacked one inside the other in a side-by-side arrangement. Several individual nozzles, one for each ink chamber, are arrayed in a linear fashion across the face of the printhead. Because of the use of multiple nozzles, rather than one centralized nozzle, this configuration requires a relatively large space within the printer.

Accordingly it is clear that a need exists for an ink jet printhead that reduces the overall width of the printhead cartridge without reducing either the individual volumes defined by each ink chamber or the total combined volume of all of the ink chambers.

SUMMARY OF THE INVENTION

It is therefore a primary object of the present invention to overcome the above-described limitations and disadvantages in the multiple chamber liquid ink jet printhead art.

An additional object of the present invention is to provide a multi-chamber liquid ink jet printhead that is both characterized by a relatively large overall ink storage volume within the chambers and that is further characterized by a relatively small footprint, or total space, occupied by the printhead.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, a multi-chamber ink jet printhead is provided comprising a plurality of ink chambers, each ink chamber having an exit port, wherein at least one chamber is arranged substantially perpendicular to and adjacent with at least one other chamber. Preferably, the exit port of each chamber is located so as to minimize the distance between the exit ports.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
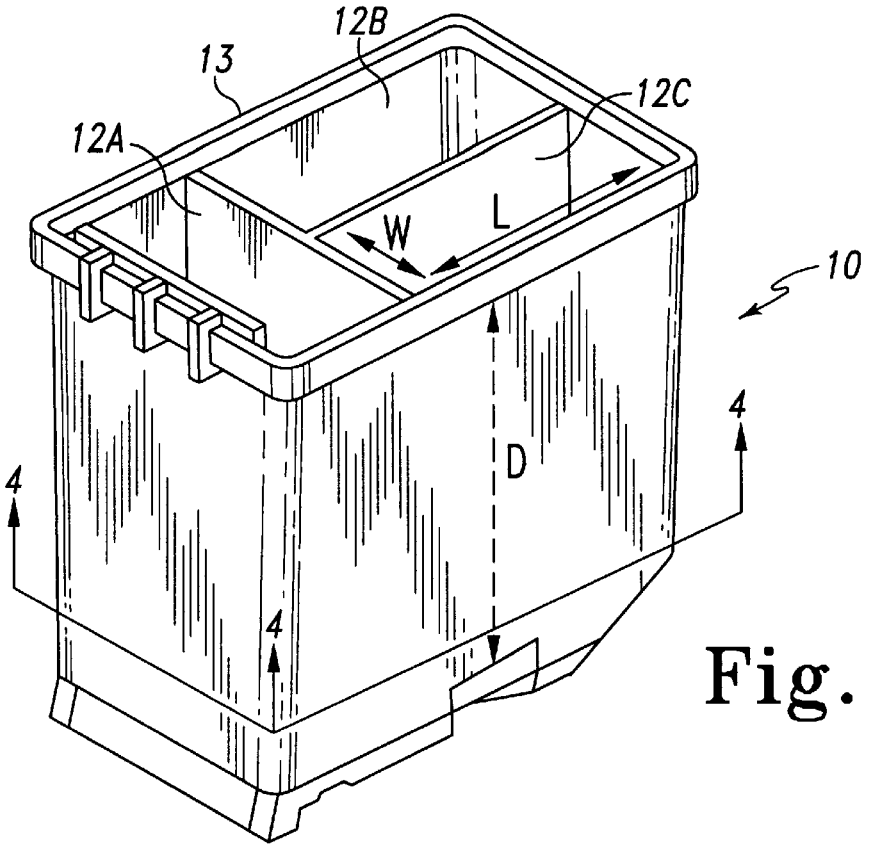
FIG. 1 is a top perspective view of the multi-chamber ink jet printhead of the present invention showing the preferred arrangement of the ink chambers.

Reference is now made to FIG. 1 illustrating the multi-chamber ink jet printhead cartridge of the present invention generally indicated by the reference numeral 10. The printhead cartridge 10 comprises more than two ink chambers 12. More preferably, it comprises three ink chambers 12A–C. As will become apparent by reviewing the description below, the multi-chamber ink jet printhead cartridge 10 of the present invention provides an effective means for maximizing the overall volume and ink storage capability of the cartridge 10 while minimizing the footprint or total space occupied by the print cartridge 10.

The cartridge can be molded by any method known in the art, including injection molding, compression molding, transfer molding or thermoforming. Preferably it is injection molded from an engineering thermoplastic. Suitable thermoplastics include, but are not limited to, polyesters, polycarbonates, polypropylenes, polyethylenes and modified polyphenylene oxides (PPO) and blends thereof. The thermoplastics may be filled or unfilled. Suitable fillers can include, but are not limited to minerals, glass or graphite. Preferably, the cartridge is molded from an unfilled, modified PPO, such as is available from the General Electric Company of Pittsfield, Mass. under the trade name Noryl®. More preferably, the cartridge is molded from Noryl® SE 1-701. Features of the cartridge 10, such as exit ports and chambers can be machined into the molded cartridge or bonded onto the cartridge in a secondary operation. Preferably, all features are molded into the cartridge.

As shown in FIG. 1, typical ink chambers 12A–C have a length L and a width W. Preferably, in the ink chambers of the present invention, the length L is greater than the width W such that the ink chambers 12A–C each have a substantially rectangular shape. However, ink chambers may be substantially square in shape, i.e., the L and W dimensions are about equal to one another. Each chamber 12A–C used in the present invention may have different L dimensions and different W dimensions from those of the other chambers. Preferably, at least two of the chambers 12A–C have substantially the same L dimensions and substantially the same W dimensions. More preferably, all chambers in the ink jet printhead 10 have substantially equivalent L dimensions and substantially equivalent W dimensions. Preferably, chambers 12A–C combine to form a unitary multichambered ink reservoir having a unitary outer wall 13.

Each chamber also has a volume defined by the L and W dimensions and by a D dimension, which represents the depth of the chamber. It is preferred that each of the chambers in the printhead 10 have substantially the same volume, even if they do not have the same L, W and D dimensions.

Figure 3:
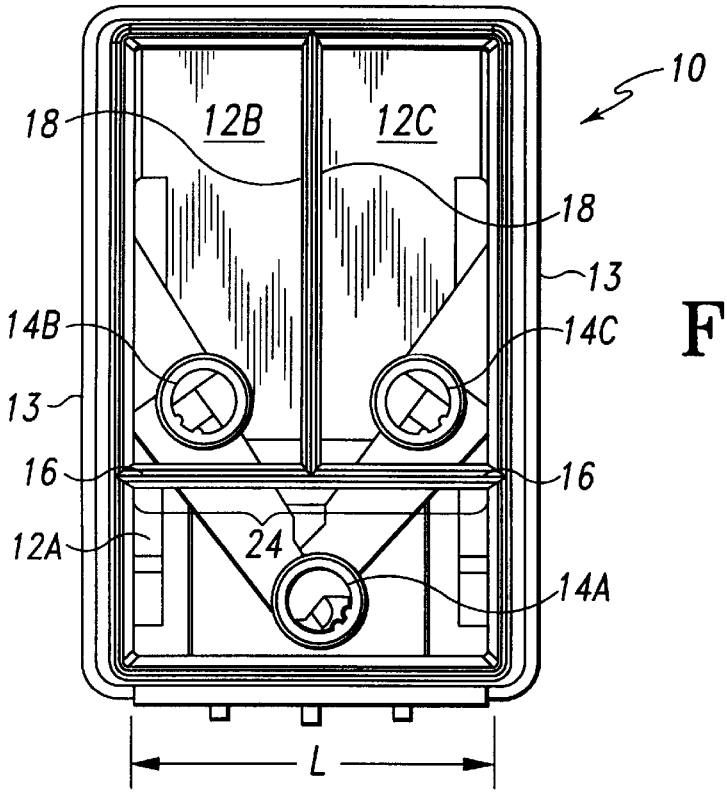
FIG. 3 is a top plan view of FIG. 1 of the multi-chamber ink jet printhead of the present invention showing the preferred arrangement of the ink ports.

As best shown in FIGS. 1 and 3, at least one ink chamber 12A is preferably arranged substantially perpendicularly to and substantially adjacent with at least two other chambers 12B, 12C wherein substantially perpendicularly is defined as the L dimension of one chamber being perpendicular to the L dimension of at least one other chamber. Preferably at least two of the chambers 12B, 12C are arranged side-by-side, so that their L dimensions are parallel with one another, with another chamber 12A arranged perpendicularly to the other chambers. All chambers are preferably contiguous to one another in that at least one side wall of each chamber is touching or adjacent to a side wall of another chamber. As it will be understood, this configuration advantageously allows for the cartridge 10 to be less cumbersome and of smaller dimensions than prior art cartridges without reducing the amount of ink capable of being stored therein.

Figure 4:
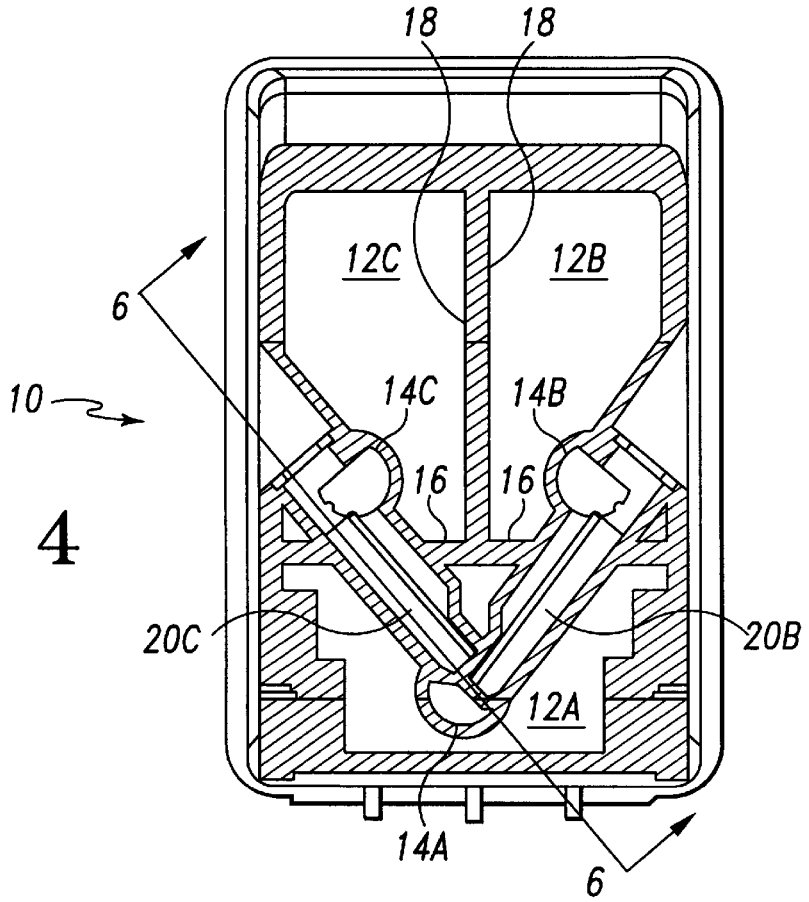
FIG. 4 is a bottom cross-sectional view along line 4—4 of FIG. 1 of the multi-chamber ink jet printhead of the present invention showing the preferred arrangement of the ink ports and ink channels.
Figure 6:
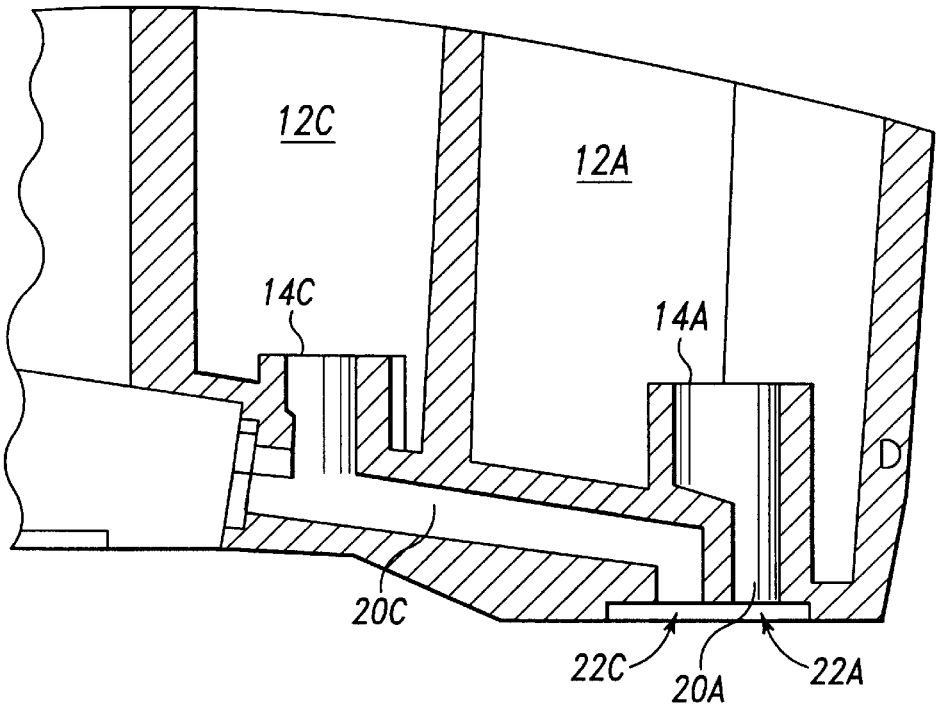
FIG. 6 is a cross-sectional view along line 6—6 of FIG. 4 showing two ink chambers and corresponding ports.

As best shown in FIGS. 3, 4 and 6, at the base of each chamber 12A, 12B and 12C is a corresponding exit port 14A, 14B and 14C, respectively. Sometimes the exit ports will be referred to collectively as exit ports 14. Also, sometimes a port will be referred to as exit port 14 if the discussion is equally applicable to all such exit ports individually. It is from these exit ports 14 that the ink leaves the various chambers and flows through a corresponding channel 20A, 20B, 20C towards respective ink orifices 22A, 22B, and 22C. Sometimes the channels 20A, 20B and 20C will be referred to collectively as channels 20 and ink orifices 22A, 22B and 22C will be referred to collectively as orifices 22.

For use in the present invention, the location of the chambers 12A–C and the exit ports 14 in each chamber may be arranged so that when the chambers are arranged in the printhead 10, the exit ports 14 are in close proximity to one another so as to minimize the overall distance between any of the ports. As it will be understood, this arrangement minimizes the distance that the ink must traverse through the channels 20 in order to reach the orifices 22.

Alternatively, and more preferably from a manufacturing perspective, the exit port 14A is located in a central portion of chamber 12A, and exit ports 14B and 14C are located so as to maintain a minimum spacing, such as for example 1 millimeter, between the outer circumferential surface of exit ports 14B and 14C and the respective adjacent walls 13 and 16. By utilizing such a configuration, the amount of material which must be removed in machining channels 20B and 20C is minimized, while the clearance between ports 14B and 14C and the respective adjacent walls 13 and 16 is maintained so as to permit the installation of a filter cap (not shown) over the respective exit port.

In the preferred embodiment where three ink chambers are used, it is preferable that each of the two parallel chambers includes a relatively longer central side wall 18 and a relatively shorter central side wall 16. Additionally, the two parallel chambers 12B, 12C may share one relatively long central side wall 18. The perpendicular chamber 12A preferably includes a relatively long central side wall 24 as well. It should be appreciated that the two relatively shorter central side walls 16 of the parallel chambers 12B, 12C may comprise the one relatively long central side wall 24 of the perpendicular chamber. The exit ports 14 of the two parallel chambers 12B, 12C are disposed in close proximity with the corresponding relatively longer side walls 18 and relatively shorter central side walls 16 of each parallel chamber. The exit port 14 of the perpendicular chamber is preferably located in close proximity with the relatively long central side wall 24 of the perpendicular chamber in the center of the L dimension of the perpendicular chamber.

More preferably, as shown in FIG. 3, the three exit ports 14 are arranged in a substantially triangular configuration wherein a line connecting a point in the center of each port would produce a triangle. The exit port in the perpendicular chamber may or may not be centrally located with respect to the W dimension of the perpendicular chamber. It may be located closer to the wall of the perpendicular chamber that abuts the parallel chambers. Preferably, the triangle formed by a line drawn through a point in the center of each exit port is an equilateral triangle.

Figure 2:
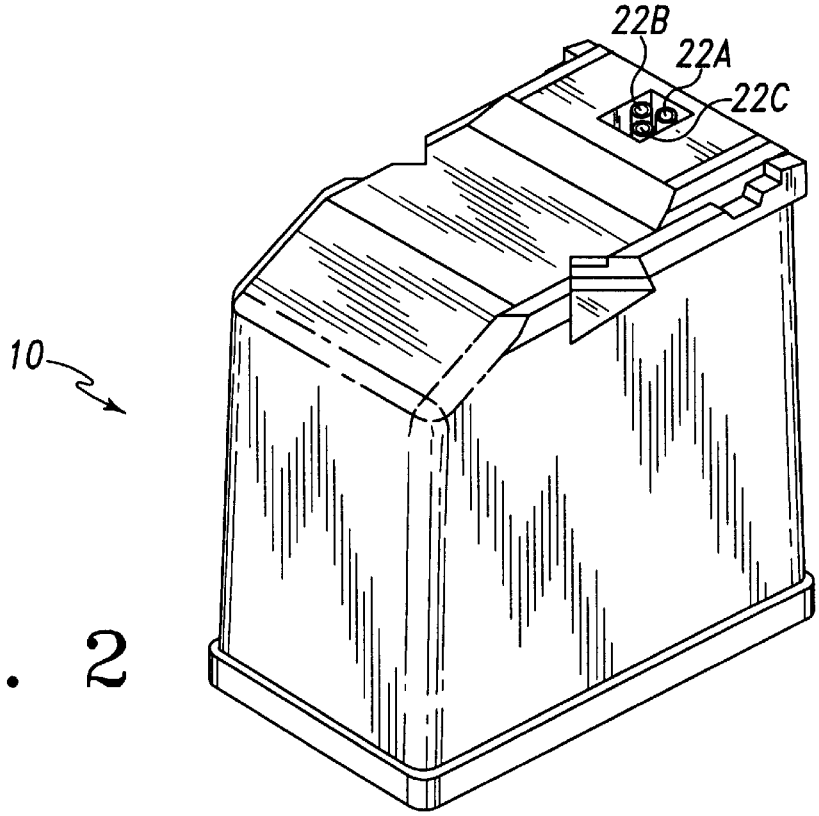
FIG. 2 is a bottom perspective view of the multi-chamber ink jet printhead of the present invention showing the ink orifices.
Figure 5:
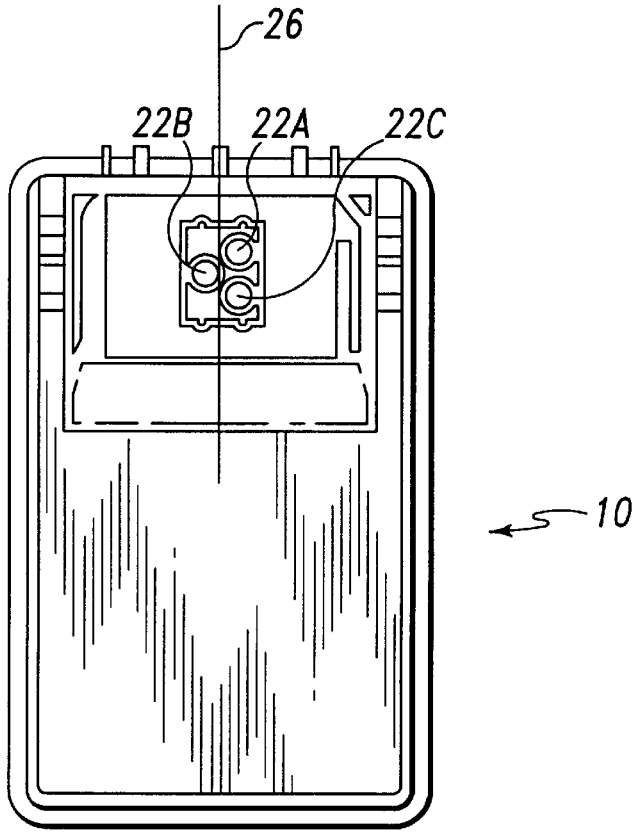
FIG. 5 is a bottom plan view of the multi-chamber ink jet printhead of the present invention showing the ink orifices.

For use in the present invention, the orifices 22 of the ink jet printhead can be located anywhere in the printhead. However, it is preferable that they be located so as to minimize the overall ink flow distance from the exit ports 14 through the channels 20 to the orifices 22. More preferably, the orifices 22 are located on the base of the printhead cartridge 10 (see FIGS. 2, 5 and 6) in close proximity to the exit port 14 of the perpendicular chamber. However, there is no limitation as to the location of the orifices. As shown in FIG. 5, all orifices preferably touch or overlap a line 26 bisecting the cartridge from front to back.

In summary, numerous benefits have been described which result from employing the concepts of the invention. The multi-chamber ink jet printhead 10 of the present invention is less cumbersome than the prior art multi-chamber ink jet cartridges and is characterized by relatively large overall ink storage volume within the chambers 12A–C and a relatively small footprint, or total space, occupied by the printhead cartridge 10. Additionally, the ink jet printhead cartridge 10 may include ink output ports arranged so as to reduce the distance the various inks must flow to reach corresponding output orifices. Finally, the multi-chamber liquid ink jet printhead 10 is capable of being used on existing as well as later-developed ink jet printers.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A multi-chamber ink jet printhead cartridge comprising a plurality of ink chambers, each ink chamber having an exit port, and said each ink chamber having a length and a width, the length of said each ink chamber being greater than the width, said plurality of ink chambers including at least one perpendicular chamber and at least two other chambers, wherein said at least one perpendicular chamber is arranged such that the length of said at least one perpendicular chamber is substantial perpendicular to the lengths of said at least two other chambers, and said at least one perpendicular chamber is substantially adjacent with said at least two other chambers, wherein each chamber of said plurality of ink chambers is of substantially the same volume, wherein said plurality of ink chambers includes at least two parallel chambers disposed side-by-side such that the lengths of said at least two parallel chambers are substantially parallel, wherein said plurality of chambers comprises three ink chambers, said three ink chambers being a first parallel chamber, a second parallel chamber and a perpendicular chamber, the length of said first parallel chamber being parallel to the length of said second parallel chamber, and the length of said perpendicular chamber being perpendicular to the lengths of said first and second parallel chambers, wherein said first and second parallel chambers each comprise a relatively shorter central side wall that substantially abuts a relatively longer central side wall of said perpendicular chamber, each of said first and second parallel chambers further comprising a relatively longer central side wall, the relatively longer central side wall of said first parallel chamber substantially abutting the relatively longer central side wall of said second parallel chamber said exit port of each of said first and second parallel chambers being further disposed in close proximity with said relatively shorter and said relatively longer central side, walls of said first and second parallel chambers, said exit port of said perpendicular chamber being disposed in close proximity with said relatively longer central side wall of said perpendicular chamber, wherein said exit port of said perpendicular chamber is disposed close to a midpoint of said relatively longer central side wall of said perpendicular chamber.

2. A multi-chamber ink jet printhead cartridge comprising a plurality of ink chambers, each ink chamber having an exit port, and said each ink chamber having a length and a width, the length of said each ink chamber being greater than the width, said plurality of ink chambers including at least one, perpendicular chamber and at least two other chambers, wherein said at lease one perpendicular chamber is arranged such that the length of said at least one perpendicular chamber is substantially perpendicular to the lengths of said at least two other chambers, and said at least one perpendicular chamber is substantially adjacent with said at least two other chambers, further comprising an ink-dispensing orifice corresponding to each of said plurality of ink chambers and a flow channel corresponding to each of said plurality of ink chambers, wherein, for each of said plurality of ink chambers, said exit port is connected by said corresponding flowchannel to said corresponding ink-dispensing orifice, wherein said orifices are located on a base portion of the cartridge in close proximity with said exit port of said at lest one perpendicular a chamber, wherein said orifices touch a line bisecting the length of said at least one perpendicular chamber.

3. The ink jet printhead cartridge of claim 2, wherein said exit ports are arranged in an equilateral triangle configuration.

4. A multi-chamber ink jet printhead cartridge comprising a plurality of ink chambers, each ink chamber having an exit port, and said each ink chamber having a length and a width, the length of said each ink chamber being greater than the width, wherein at least one perpendicular chamber is arranged such that the length of said at lest one perpendicular chamber is substantially perpendicular to the lengths of at least two other chambers, and said at least one perpendicular chamber is arranged substantially adjacent with said at least two other chambers, and wherein said exit port of each chamber is located so as to minimize the distance between said exit ports, wherein said plurality of chambers comprises three ink chambers, said three ink chambers being a first parallel chamber, a second parallel chamber and a perpendicular chamber; the length of said first parallel chamber being parallel to the length of said second parallel chamber, and the length of said perpendicular chamber being perpendicular to the lengths of said first and second parallel chambers, wherein said first and second parallel chambers each comprise a relatively shorter central side wall that substantially abuts a relatively longer central side wall of said perpendicular chamber, each of said first and second parallel chambers further comprising a relatively longer central side wall, the relatively longer central side wall of said first parallel chamber substantially abutting the relatively longer central side wall of said second parallel chamber, said exit port of each of said first and second parallel chambers being further disposed in close proximity with said relatively shorter and said relatively longer central side walls of said first and second parallel chambers, said exit port of said perpendicular chamber being disposed in close proximity to the, midpoint of said relatively longer central side wall of said perpendicular chamber.

5. The ink jet printhead cartridge of claim 4, wherein said exit ports of said plurality of ink chambers are located to form an equilateral triangle configuration of exit ports.

* * * * *